United States Patent [19]

Slenker

[11] Patent Number: 5,063,690

[45] Date of Patent: Nov. 12, 1991

[54] SHOE OR BOOT HEATER WITH SHOELACE MOUNTED POWER SOURCE

[76] Inventor: Stephen Slenker, 26 Cummings Rd., Tyngsboro, Mass. 01879

[21] Appl. No.: 466,213

[22] Filed: Jan. 17, 1990

[51] Int. Cl.[5] ..... A43B 7/02

[52] U.S. Cl. ..... 36/2.6; 36/136; 36/132

[58] Field of Search ..... 36/2.6, 136, 132

[56] References Cited

U.S. PATENT DOCUMENTS

| | | | |
|---|---|---|---|
| 1,288,045 | 7/1918 | Kuhn et al. | 36/2.6 |
| 1,430,404 | 9/1922 | Radford | 36/2.6 |
| 3,859,496 | 1/1975 | Giese | 36/2.6 |
| 3,946,193 | 3/1976 | Giese | 219/211 |
| 3,977,093 | 8/1976 | Santroch | 36/2.6 |
| 4,080,971 | 3/1978 | Leeper | 128/383 |
| 4,180,922 | 1/1980 | Cieslak et al. | 36/2.6 |
| 4,507,877 | 4/1985 | Vaccari et al. | 36/2.6 |
| 4,507,882 | 4/1985 | Harrell | 36/136 |
| 4,536,975 | 8/1985 | Harrell | 36/136 |
| 4,697,359 | 10/1987 | Balbinot | 36/2.6 |
| 4,780,968 | 11/1988 | Bragagnolo | 36/2.6 |
| 4,798,933 | 1/1989 | Annovi | 219/211 |
| 4,837,494 | 6/1989 | Maier | 322/1 |

*Primary Examiner*—Paul T. Sewell
*Assistant Examiner*—Thomas P. Hilliard
*Attorney, Agent, or Firm*—Wolf, Greenfield & Sacks

[57] ABSTRACT

A universal heating system for footwear including shoes and boots in which an insole is provided with a heater element having leads extending therefrom to either the tongue area or a side area opposed to the arch of the shoe. A power source in the form of a battery pack is adapted to be mounted either in the tongue area or the side area by means of an enclasping means affixed externally of the battery pack.

9 Claims, 3 Drawing Sheets

SHOE OR BOOT HEATER WITH SHOELACE MOUNTED POWER SOURCE

BACKGROUND OF THE INVENTION

The invention relates generally to an electrical heating system for footwear and specifically to a universal heater useful for shoes or boots.

Wearers of footwear who expose themselves for long periods to cold, generally experience the discomfort of having cold feet. It has been desirable to provide devices for heating shoes or boots in order to permit the outdoor sportsman or those who must work for extended periods in the cold to be able to warm their feet periodically. Therefore, to provide a practical cost-effective solution to this problem has been the goal of many devices that have been proposed.

It has been proposed to provide a heated sock. This device is generally bulky and relatively expensive and requires frequent washings. This limits its useful life. Most sportsmen prefer wearing clean socks daily. The use of a heated sock would require that the individual own a number of pairs of socks, and accordingly the cost of acquiring them becomes prohibitive. In addition, the bulk of such socks prohibits them from being used in many sports where a thin sock is essential for foot control, such as in skiing.

Another approach to this problem has been the suqqestion for providing heated insoles. Such devices do not require washing or changing and can be installed in any shoe as an accessory. The difficulty in employing such devices is that a wire lead must run from the insole to a battery pack, which must be mounted somewhere on the person or on the footwearer itself. If a long lead is used, a substantial amount of electrical energy may be lost in the lead. Also the lead may be prone to breakage since it is subject to continuous flexure during body motion. Most insole heating devices have frequent lead breakage problems. These problems occur due to the lead length and the placement of the lead in areas of the footwear subject to repeated flexure.

It has been proposed to run a wire in a heated insole device up the leg of the wearer to a battery pack strapped to the leg or the waist. Generally, this proposal has not been successful since people prefer not to have wires running up their body merely for the comfort of a heated shoe.

In ski boots, some of these problems are solved due to the nature of the design of the conventional ski boot. Such boots generally have a thick exterior shell which is relatively strong and easily supports the weight of the battery pack. In addition, they have a removable liner or bladder, which is typically a half-inch thick and can cushion large long interconnecting wires, which run from a battery pack to a heating element. In distinction with ski boots, general footwear have thinner pliable material which generally prevents wires from being placed in desirable locations, since they do create discomfort to the user.

In order to provide a universally adaptable shoe heater, a number of problems must therefore be overcome. The device must be small yet be an efficient heating element which can be easily installed into a shoe without causing discomfort, and preferably without any noticeable change in the feeling of the shoe fit. Additionally, the interconnection between the heating element and a power supply must be such as not to cause any change in fit or any noticeable change in the feeling of the shoe fit. The location for mounting a power supply must be such that it will not impede the normal function or use of the shoe and will not become easily dislodged during use. The entire heating device must be such that it can be installed by a user and require little time and effort to accomplish the installation. The installation should be such that no damage is done to the shoe and the device should be removable with very little or no evidence of its previous installation. The heating device should also be such that it is not easily broken or damaged in the normal functioning of it by the user or in the activity for which the footwear is used. The heating device should also be removable for replacement or repair. Also, the time required for removing the power supply should be very little in the event the user decides he/she does not desire further heating to take place.

SUMMARY OF THE INVENTION

The present invention provides a footwear heating system which is universally applicable to various types of shoes and boots while being of economic design.

The present invention comprises a universal footwear heating system which includes a heating element having conductor leads extending therefrom and a power pack assembly which is connectable to such leads. It is one object of the invention to provide a heating element for footwear which has conductor leads so located as to have their presence relatively undetectable to the wearer.

The location of a battery pack for a universal shoe heater is most important. If the battery pack were to be located on the back or heel area of the footwear, any mounting arrangement for the battery pack would tend to weaken the shoe since virtually all shoes are sewn together directly in the center of the heel area and therefore any holes or modifications to this area would tend to weaken the shoe. Further, any protrusion emanating from the rear of the shoe would tend to cause interference when climbing down stairs, and even might cause the wearer to trip or to disengage the battery pack. Another possible location is on the inside or arch side of the shoe. However, during the normal function of walking, most people move their feet close enough to each other so that any protruding object such as a battery pack on the archside of the shoe would interfere with this motion and may cause the wearer to trip.

It is therefore an object of the invention to provide a location for a battery pack on footwear which does not interfere with walking or climbing, nor with the normal use to which the wearer desires to employ the footwear.

BRIEF DESCRIPTION OF THE DRAWINGS

The present invention will be more readily understood by reference to the following drawings in which.

DETAILED DESCRIPTION OF THE INVENTION

Figure 1:
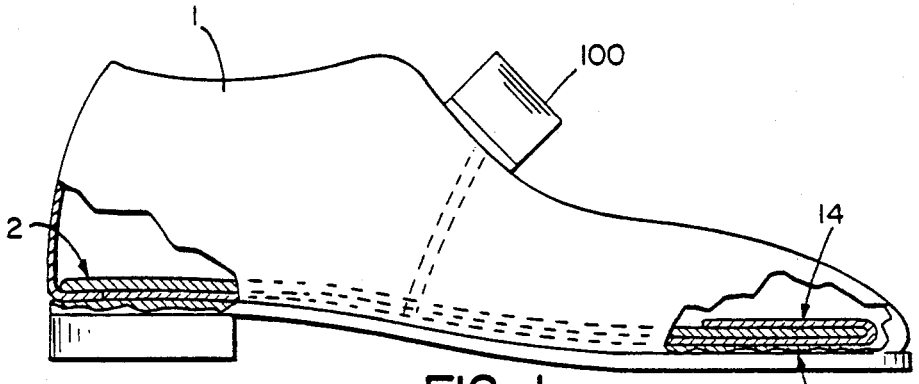
FIG. 1 is a side view, partially in cross-section, of a footwear employing the invention.
Figure 1A:
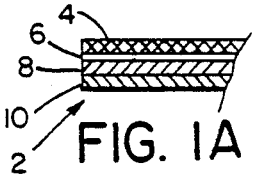
FIG. 1A is a partial cross-sectional view of the heel portion of the footwear of FIG. 1.
Figure 3:
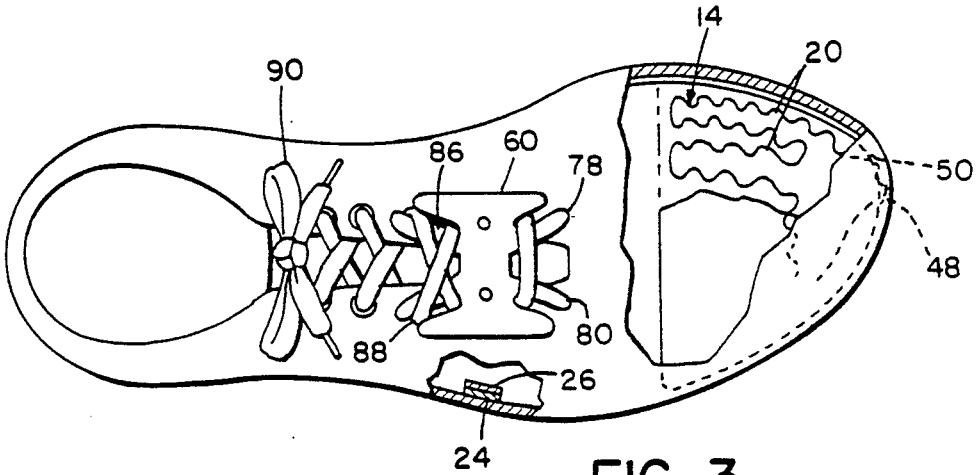
FIG. 3 is top view, partially in cross-section, of the footwear of FIG. 1.

FIG. 1 shows an ordinary shoe which may be fitted with the heating means of the invention. As shown, the footwear 1 is provided with an insole 2 which is placed on the inside of the footwear at the bottom. The insole extends from the heel portion to the toe portion of the shoe. The insole, as shown in the broken away cross section of the heel portion of FIG. 1A, is comprised of a top-soft felt-like layer 4 which is bonded by means of a layer of adhesive 6 to a foam layer 8, which in turn has bonded to it an aluminum foil heat insulator layer 10. This insole is well known in the art and is commercially available. As shown in FIG. 1 and in more detail in FIG. 1B, the toe end 12 of the insole is provided with the heating element 14 which is affixed to the upper surface or top layer 4 of the insole. This heating element 14 as shown in FIG. 3 is formed as a series of heater wires or coils 20 interconnecting leads 48 and 50 a explained more fully hereafter.

Figure 1B:
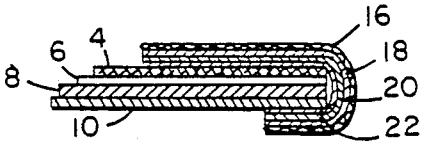
FIG. 1B is a partial cross-sectional view of the toe portion of the footwear of FIG. 1.

As shown in the cross-sectional FIG. 1B, the toe end located heater consists of an upper layer 16 of soft felt-like material which overlays an upper plastic film 18. Heating wires 20 are embedded between the upper plastic film 18 and a lower plastic film 22. This heater assembly is wrapped around the edge 3 of the insole as seen from FIGS. 2 and 3 wherein the connector wires 48 and 50 embedded within conductor leads 24, 26 respectively, are separated as they are returned under the insole. The layer 16 is terminated a short distance from edge 3. The conductor leads 24 and 26 are also encapsulated in plastic and a power supply 100 is mounted in the area where shoe laces normally appear in the footwear. The power supply 100 (see FIG. 1) is mounted to the footwear by means of a mounting bracket 60 which is more fully described hereafter.

Figure 2:
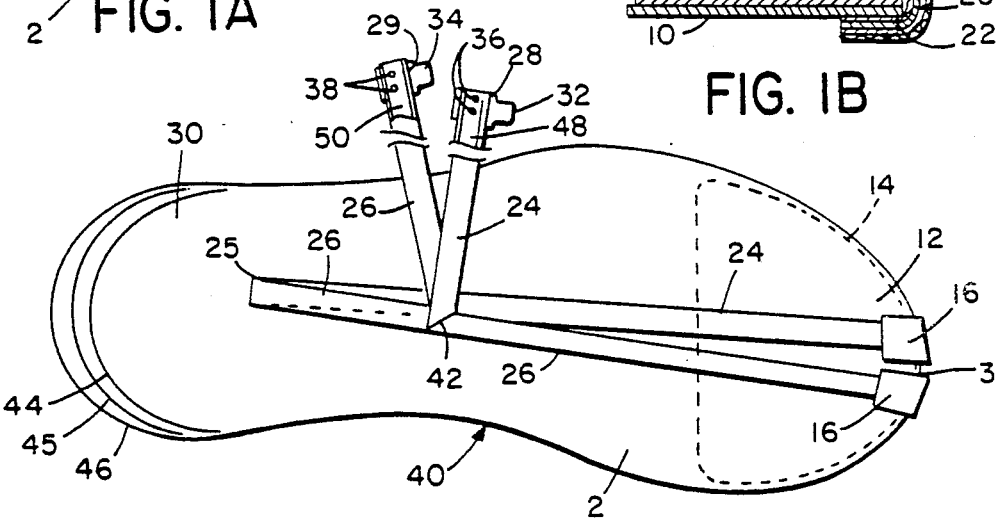
FIG. 2 is a bottom view of an insole employed in the footwear of FIG. 1.

The insole, as shown in FIG. 2, is generally formed with a heel area 30 as well as the toe area 12. It can be trimmed along the size lines 44, 45 and 46 for different size shoes. The conductor leads 24 and 26, as shown in FIG. 2, lead from the leading edge 3 of the toe portion 12 and extend from that portion towards the heel area 30 where they are folded as at 25 and directed back towards the arch area 40. When the conductor leads reach the arch area, they are again folded as at 42 so that they can then be directed towards the upper side wall portion of the shoe. The conductor leads 24, 26 comprise connector wires 48 and 50 which are embedded in the plastic layers that are relatively wider. The conductor wire 48 has affixed to it at its extremity the connector lug 28 by means of rivets 36. The lug 28 has a connector arm portion 32 extending therefrom. In a similar fashion, the conductor wire 50 has affixed to it a connector lug 29 by rivets 38. The connector lug 29 has a connector arm portion 34 extending therefrom.

It will be realized from the foregoing that the conductor elements have a rather wide form when they serve merely as a lead but become relatively narrow when they serve as a heating element. Typically, the conductor leads may be as much as 8 to 20 times larger in width as compared to the portion which serves as the heat conductor. This large ratio allows very little power to be disippated in the lead. In addition, troublesome interconnection of lead wires to heating elements is avoided. In addition, the lead is typically very flat, i.e., in the order of 0.009 inch, and therefore can be installed and directed along the inside of the shoe and covered with a thin membrane or felt layer, which can be attached by adhesive. In this manner, the lead becomes immovable and practically unnoticeable to the wearer. It normally will not be felt by the foot of the wearer, even though a hand may determine its location.

Careful selection of the location where the flat conductor lead wires are folded i.e., by doing the folding at very low pressure points, it is possible to make the presence of the leads relatively undetectable to the wearer. The location for the folds, as indicated above, is along the side of the shoe away from the arch and approximately opposed to the center of the arch. If the leads are then passed along the inside surface of the shoe between the tongue and the top of the shoe, the presence of the lead will not be detected by the foot if the lead is properly installed.

Figure 4:
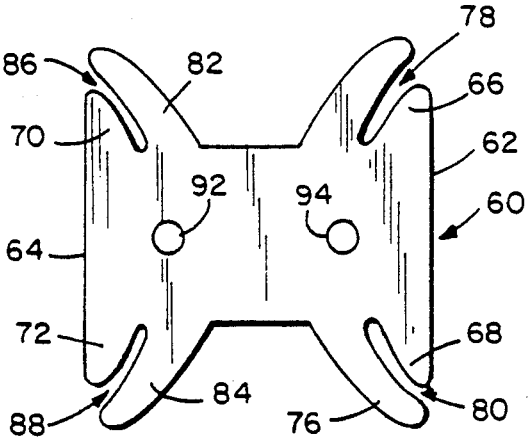
FIG. 4 is a top view of a mounting bracket for a power supply used in connection with the footwear of FIG. 3.
Figure 5:
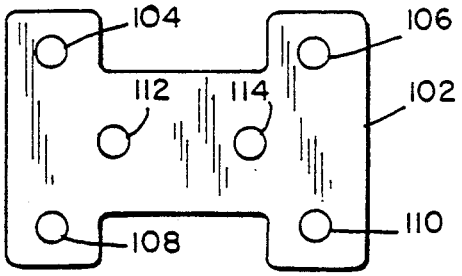
FIG. 5 is a plan view of an alternate form of mounting bracket.

As shown in FIGS. 1 and 3, the power supply 100 is mounted to normal shoe laces 90 of a shoe by means of a mounting bracket 60. The nature of the mounting bracket is more clearly shown in FIG. 4. Thus, the bracket 60 is a relatively thin flat member of generally rectangular shape. The right side 62 of the bracket is formed with upper and lower protrusions 66 and 68 and the left side 64 of the bracket is similarly formed with upper and lower protrusions 70 and 72. Additionally, there are formed upper and lower fingers 74 and 76 on the right side of the bracket, and upper and lower fingers 82 and 84 on the left side of the bracket. Between the respective fingers and protrusions, there are formed a series of openings 78, 80, 86 and 88. Additionally, the central part of the bracket is provided with mounting holes 92 and 94 to enable assembly of the bracket 60 to the power supply 100 as shown in FIG. 1. As seen in FIG. 3, the mounting bracket 60 is affixed to the shoe by having the laces 90 pass into and out of the various openings 78, 80 and 86, 88. When the shoe laces are tied, the power supply will then be fixedly retained in position. Normally, if the power supply is mounted at the lower end of the shoe lace assembly it will not be disturbed even when the shoes are unlaced, since normally shoes are not unlaced all the way down to the bottom but merely the top few eyelets are unlaced. In the above manner, the power supply is enabled to be mounted in a position that is least disturbing to the wearer and the leads are very short so as to also provide little or no aggravation to the wearer. It has been found that this location of the battery pack is one which will not interfere with the normal activities of the user. An alternate form of mounting bracket is shown in FIG. 5, wherein the bracket 102 is provided with a series of holes 104, 106, 108 and 110 to allow the shoe laces to be threaded into and out of the bracket so that a more positive fixing of the battery pack is afforded. For this purpose, the holes 112 and 114 are provided to enable mounting to the battery pack.

Figure 6:
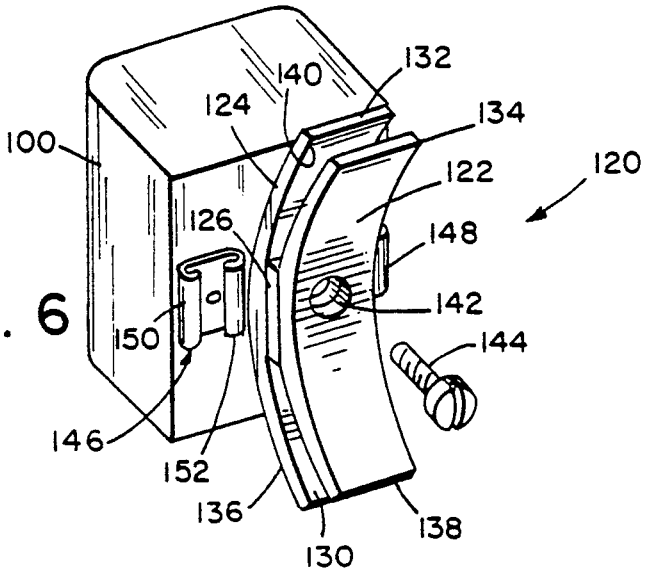
FIG. 6 is a perspective of a power supply showing a further form of mounting bracket which may be employed in connection with footwear.

FIG. 6 shows the bottom portion of the power supply 100 to indicate the manner in which the connector leads are affixed to the battery, and also to show a further modified form of mounting bracket. In this figure, a mounting bracket 120 is formed by means of a pair of curved plates 122 and 124. These plates are connected by connector block 126 which can be welded or otherwise affixed to the two connector plates. The ends 132, 134, 136 and 138 of the respective curved plates 122 and 124 are tapered on their inner surface in such a manner as to provide tapered openings 130 and 140 at either end of the mounting bracket 120. These tapered openings enable assembling the mounting bracket directly into the sides of the shoe adjacent to the shoe lace area. It is generally known that this portion of a shoe is reinforced by stitching and readily enables the retention of a battery pack mounted in the matter as indicated. The bracket 120 is further provided with a through hole 142 and is fastened to the power supply 100 by means of a screw 144.

As indicated above, an alternate manner in which the connectors 32 and 34 are affixed electrically to receive power from the battery pack is shown in FIG. 6. The terminals are formed as connector lugs 146 and 148. Only one of these lugs will be described since they are both formed identically. Thus, connector lug 146 has folded over ends 150 and 152 to provide a receptacle to receive the prong formed by the connector ar 32 for lead 24, for example.

Figure 7:
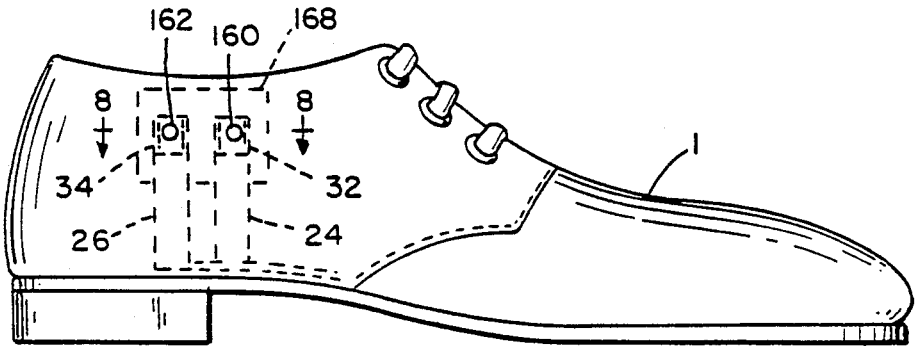
FIG. 7 is a side view of footwear showing an alternate mounting arrangement for power supply.
Figure 8:
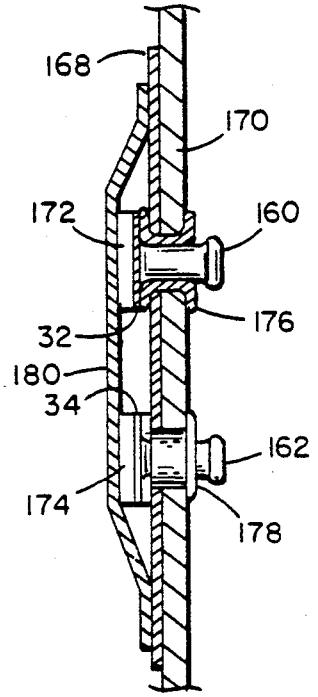
FIG 8 is a cross-sectional view taken along line 8—8 through the side of the footwear shown in FIG. 7.

Another possible acceptable location for mounting the power supply on a shoe is shown in FIG. 7. This location is on the outer side of the shoe away from the arch. This surface appears to be the best alternative surface to the preferred shoe lace and tongue area of the shoe since it would not interfere with wa king or climbing down stairs. Also, many times where shoes have protrusions or mechanisms on their upper surface, this location can be used without interference of the fastening mechanism for the power supply. As shown in FIG. 7, the conductor leads 24 and 26 may be held in place by having their connector arms 32 and 34 formed with holes to be mounted as shown in FIG. 8. Thus, the connector 32 is mounted to a male snap fastener 160, which is formed by having its head 172 formed in a normal manner within a ferrule 176 which passes through an opening in the side wall 170 of the shoe. The connector arm 32 is captured in this manner by the assembly of the snap fastener by being placed beneath the head 172. In a similar manner, a snap fastener 162 is affixed to the side wall 170 and the fastener 162 is provided by having a head 174 and a ferrule 178. A reinforcement strip 168, which may be of leather, is used to improve the stiffness of the footwear for attachment of the connector arrangement described. Also, a layer of leather or other material 180 can be provided to smooth out and cover over the snap fasteners. Although not shown in the drawings, the power supply could have complementary female snap fasteners embedded in its under surface in place of the connector lugs 146 and 148 shown in FIG. 6, for example.

Figure 9:
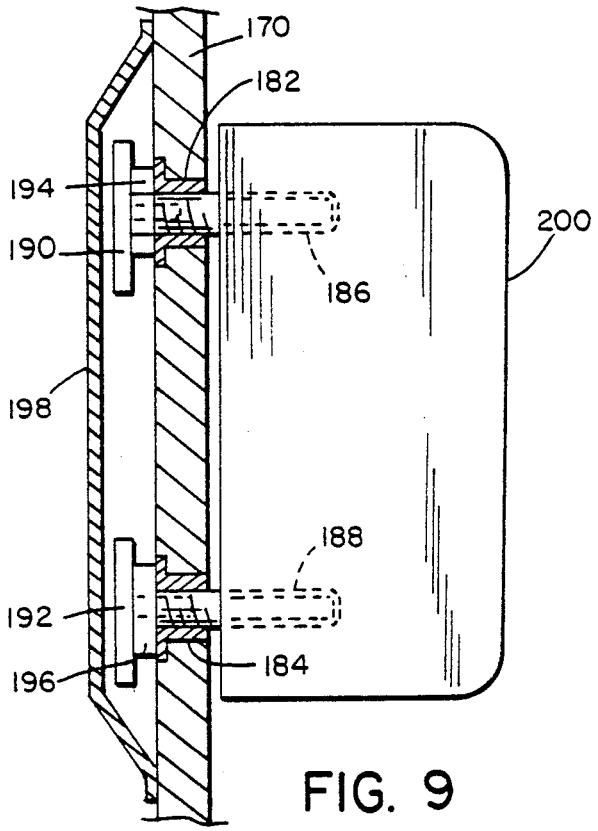
FIG. 9 is a cross sectional view through the side of footwear similar to Figure 8 showing an alternate mounting means for a power supply.

An alternate manner of mounting a power supply is shown in FIG. 9, where a battery pack 200 has special conducting screws 186 and 188 assembled into it to provide the electrical connection. These screws 186 and 188 are formed by employing special headless Allen screws which have assembled to one end special washers 190 and 192, respectively in a manner to capture the connector arms 194 and 196 respectively, of lead wires to the heating element. A layer of leather 198 is preferably provided to be bonded above these connectors to the wall 170 of the shoe so as to cushion the foot of the wearer in this area.

Figure 10:
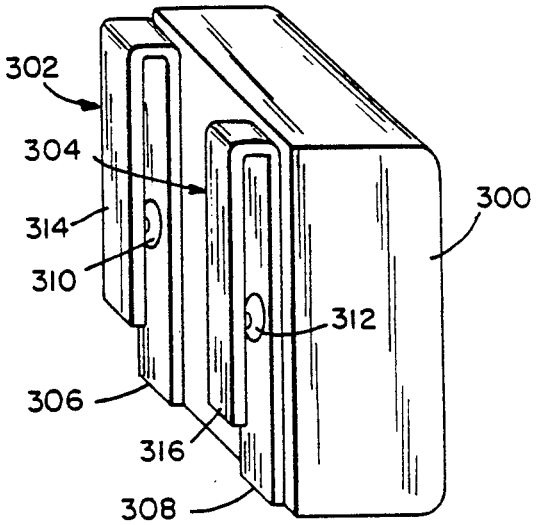
FIG. 10 is a perspective view of a power supply showing a still further alternate mounting means.
Figure 11:
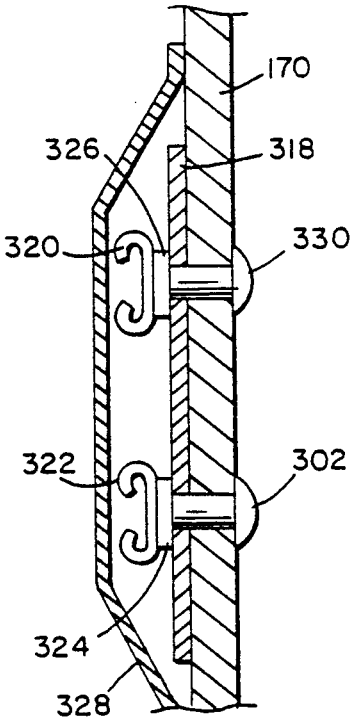
FIG. 11 is a cross-section view through the side of footwear showing the connector plugs for receiving the power supply of FIG. 10.

A still further alternate means of mounting a power supply on the outerside of the shoe is shown in FIGS. 10 and 11. Thus, the power supply 300 is provided with a pair of U-shaped contact elements 302 and 304 for conducting power from the power supply to the heating element. These contact elements are formed with long legs 306, 308 and short legs 314 and 316, respectively. The long legs are affixed to the power supply 300 by means of rivets 310 and 312 which also form the electrical connection. The conductor lead arms 324 and 326 shown in FIG. 11 are affixed to be in electrical and mechanical contact with respective sockets 322 and 320. The short legs 314 and 316 of the contact elements 302, 304 make contact with the lead arms 324 and 326 by means of the sockets 320 and 322, respectively. These sockets are affixed to the wall 170 of the shoe by adhesive or by means of ferrules or rivets 330 and 332, respectively. Again, a reinforcement member 318 may be used similar to the reinforcement member 168 shown in FIG. 7. Further, a layer of leather 328 can be placed around these elements to provide a cushioning effect to the wearer.

The invention and its attendant advantages will be understood from the foregoing description and it will be apparent that various changes may be made in the form, construction and arrangements of the parts without departing from the spirit and scope thereof or sacrificing its material advantages, the arrangements herein before described being merely by way of example. For example, where footwear does not use laces, such as in the case of hip wader boots or other non laced shoes, it is possible to install a set of snap fasteners with conductor leads connected thereto (see the description of FIG. 8 above) in what would be the shoe lace front area and the power supply used would have complementary snap fasteners (see pp. 13, the last four lines). I do not wish to be restricted to the specific forms shown or uses mentioned, except as defined in the accompanying claims, wherein various portions have been separated for clarity of reading and not for emphasis.

What I claim is:

1. A system for heating an article of footwear having a sole, sides, a heel and toe area, comprising:

a removable insole extending from the heel area to the toe area of the footwear article, a heating element disposed upon the surface of said insole, electrical leads extending from said heating element and directed beneath said insole to an area of said footwear which experiences relatively low pressure from dynamic loads generated by normal activities of a user of said footwear, a compact power source means, said power source means being provided with contact means externally thereof, said electrical leads being provided with connector means at their ends adapted to provide for electrical connections externally of said footwear article and centrally therefrom, an enclasping means comprising a relatively rigid mounting bracket having means for enclasping laces which may be employed to secure the footwear article to the foot of the wearer, said power source and power source contact means mounted on said enclasping means in a location thereon that does not interfere with said normal activities of the user and that allows said power source to be connected to said connector means.

2. A system for heating an article of footwear having a sole, sides, a heel and toe area, comprising:

a removable insole extending from the heel area to the toe area of the footwear article, a heating element disposed upon the surface of said insole, electrical leads extending from said heating element and directed beneath said insole to an area of said footwear which experiences relatively low pressure from dynamic loads generated by normal activities of a user of said footwear, a compact power source means, said power source means being provided with contact means externally thereof, said electrical leads being provided with connector means at their end to provide for electrical connections externally of said footwear article and centrally therefrom, and enclasping means comprising a relatively rigid mounting bracket having means for permitting the passing therethrough of laces which may be employed to secure the footwear article to the foot of the wearer, said power source means and said power source contact means mounted on said footwear article in a location thereon that does not interfere with said normal activities of the user and that allows said power source to be connected to said connector means.

3. The system of claim 2 wherein the enclasping means comprises a pair of U-shaped clamps which are of electrically conductive material and so mounted as to serve also as the power source contact means.

4. The system of claim 3 wherein complementary mating means to receive said clamps are provided to which said electrical lead connector means are assembled.

5. A system for heating an article of footwear including a sole, sides, a heel and toe area nd laces for securing the article to the foot of a wearer, comprising:

a removable insole extending from the heel area to the toe area of the footwear article, a heating element disposed upon the surface of said insole, electrical leads extending from said heating element and directed beneath said insole, a compact power source means, said power source means being provided with contact means externally thereof, said electrical leads being provided with connector means at their ends adapted to extend externally of said footwear article and centrally therefrom to the area of said laces, and enclasping means upon which said power source and said power source contact means are mounted, said enclasping means at said area o said laces with said contact means electrically connected to said connector means.

6. A system for heating an article of footwear including a sole, sides, a heel and toe area and laces for securing the article to the foot of a wearer, comprising:

a removable insole extending from the heel area to the toe area of the footwear article, a heating element disposed upon the surface of said insole, electrical leads extending from said heating element and directed beneath said insole, a compact power source means, said power source means being provided with contact means externally thereof, said electrical leads being provided with connector means at their ends adapted to extend externally of said footwear article and centrally therefrom to the area of said laces, and enclasping means upon which said power source and said power source contact means are mounted, the enclasping means comprising a relatively rigid mounting bracket having means for enclasping laces which may be employed to secure the footwear article to the foot of the wearer, said enclasping means at said area of said laces with said power source contact means electrically connected to said connector means.

7. A system for heating an article of footwear including a sole, sides, a heel and toe area and laces for securing the article to the foot of a wearer, comprising:

a removable insole extending from the heel area to the toe area of the footwear article, a heating element disposed upon the surface of said insole, electrical leads extending from said heating element and directed beneath said insole, a compact power source means, said power source means being provided with contact means externally thereof, said electrical leads being provided with connector means at their ends adapted to extend externally of said footwear article and centrally therefrom to the area of said laces, and enclasping means upon which said power source and said power source contact means are mounted, the enclasping means comprising a relatively rigid mounting bracket having means for permitting the passing therethrough of laces which may be employed to secure the footwear article to the foot of the wearer, said enclasping means at said area of said laces with said power source contact means electrically connected to said connector means.

8. A system for heating an article of footwear having a sole, sides, an arch, a heel and toe area, comprising:

a removable insole extending from the heel area to the toe area of the footwear article, a heating element affixed to said insole, electrical leads extending from said heating element and directed beneath said insole to a central area of said footwear which experiences relatively low pressure from dynamic loads generated by normal activities of a user of said footwear, a compact power source means, said power source means being provided with power source contact means externally thereof, said electrical leads being provided with connector means at their ends adapted to extend externally of said footwear article and centrally therefrom to a side opposite to the arch, and enclasping means to mount said power source and power source contact means at said side opposite said arch with said power source contact means electrically and physically connected to said connector means, wherein the enclasping means comprises a pair of U-shaped clamps which are of electrically conductive material and so mounted as to serve also as the power source contact means.

9. The system of claim 8 wherein complementary mating means to receive said clamps are provided to which said electrical lead connector means are assembled.

* * * * *